US006035259A

United States Patent [19]

Graff et al.

[11] Patent Number: 6,035,259

[45] Date of Patent: Mar. 7, 2000

[54] WEB MATERIAL CAMBER MEASUREMENT APPARATUS AND METHOD

[75] Inventors: Ernest A. Graff, Ontario; Brooks J. Schneider, Rochester; David R. Matzan, Fairport, all of N.Y.

[73] Assignee: Eastman Kodak Company, Rochester, N.Y.

[21] Appl. No.: 08/878,173

[22] Filed: Jun. 18, 1997

[51] Int. Cl.[7] ..... G06M 1/26

[52] U.S. Cl. ..... 702/43; 702/33; 702/41; 72/11.4

[58] Field of Search ..... 702/43, 33, 41, 702/42, 57, 11.4

[56] References Cited

U.S. PATENT DOCUMENTS 4,061,222 12/1977 Rushing .
4,385,716 5/1983 De Roeck et al. .
4,444,209 4/1984 Seragnoli .
4,481,800 11/1984 Ruhl ..... 72/11.4
4,528,756 7/1985 Ichihara .
4,862,565 9/1989 Damour .
5,060,683 10/1991 Seiz et al. .
5,172,844 12/1992 Mueller .
5,211,814 5/1993 Jaakkola et al. .
5,279,454 1/1994 Morse et al. .
5,328,415 7/1994 Furutani et al. .
5,353,979 10/1994 Gartmann .
5,360,152 11/1994 Matoushek .

*Primary Examiner*—Thomas R. Peeso
*Attorney, Agent, or Firm*—Susan L. Parulski

[57] ABSTRACT

Apparatus and method for measuring camber of a web material. As the web material is transported across a conveyance roller, a load cell disposed at each end of the conveyance roller measures the force applied by the web material to the conveyance roller for a particular width location of the web material. An electrical signal corresponding to the applied force is transmitted to a computer and manipulated to a camber measurement.

3 Claims, 10 Drawing Sheets

Fig. 14

| H INCHES | DELTA ARCLENGTH INCHES | TOTAL TENSION LBS. | F1 LBS. | F2 LBS. | DIFF. TENSION LBS. |
|---|---|---|---|---|---|
| 0 | 0 | 0 | 0 | 0 | 0 |
| 0.05 | 0.036 | 4.86 | 1.62 | 3.24 | 1.62 |
| 0.1 | 0.072 | 9.72 | 3.24 | 6.48 | 3.24 |
| 0.15 | 0.108 | 14.58 | 4.86 | 9.72 | 4.86 |
| 0.2 | 0.144 | 19.44 | 6.48 | 12.96 | 6.48 |
| 0.25 | 0.18 | 24.3 | 8.1 | 16.2 | 8.1 |
| 0.3 | 0.216 | 29.16 | 9.72 | 19.44 | 9.72 |
| 0.35 | 0.252 | 34.02 | 11.34 | 22.68 | 11.34 |
| 0.4 | 0.288 | 38.88 | 12.96 | 25.92 | 12.96 |
| 0.45 | 0.324 | 43.74 | 14.58 | 29.16 | 14.58 |
| 0.5 | 0.36 | 48.6 | 16.2 | 32.4 | 16.2 |
| 0.55 | 0.396 | 53.46 | 17.82 | 35.64 | 17.82 |
| 0.6 | 0.432 | 58.32 | 19.44 | 38.88 | 19.44 |
| 0.65 | 0.468 | 63.18 | 21.06 | 42.12 | 21.06 |
| 0.7 | 0.504 | 68.04 | 22.68 | 45.36 | 22.68 |
| 0.75 | 0.54 | 72.9 | 24.3 | 48.6 | 24.3 |
| 0.8 | 0.576 | 77.76 | 25.92 | 51.84 | 25.92 |
| 0.85 | 0.612 | 82.62 | 27.54 | 55.08 | 27.54 |
| 0.9 | 0.648 | 87.48 | 29.16 | 58.32 | 29.16 |
| 0.95 | 0.684 | 92.34 | 30.78 | 61.56 | 30.78 |
| 1 | 0.72 | 97.2 | 32.4 | 64.8 | 32.4 |

WEB MATERIAL CAMBER MEASUREMENT APPARATUS AND METHOD

FIELD OF THE INVENTION

The invention concerns the transport of a web material. More particularly, the invention relates to an apparatus and method for measuring camber of the web material.

BACKGROUND OF THE INVENTION

Webster's Encyclopedic Unabridged Dictionary defines the term "camber" as "a slightly arching, upward curve, or convexity, as of the deck of a ship".

In the transport of a web material, camber generally refers to the lateral curvature of the web material. FIG. 1 illustrates a portion of a length of web material 10 having camber relative to a longitudinal axis A of the web material. Stated alternatively, if web material 10 was laid flat in plane B, there exists a curvature about an axis normal to plane B. Camber can affect the transport of the web material in a web conveyance system or web handling system. For example, camber can affect the lateral tracking offset from a desired location. Camber can also affect the lateral stability of the web material, commonly referred to as "weave". Camber can adversely affect web conveyance to such an extreme that the web cannot be conveyed through a web handling system. Accordingly, a measure or quantification of camber could provide advantages, such as an indication of how a web would track when conveyed through a web transport system.

U.S. Pat. No. 4,528,756 relates to a system for detecting camber of a rolled material. More particularly, camber is detected by detecting the right and left outlet side lengths of the rolled material using touch rollers and the plate width of the rolled material, and then processing the detected signals to calculate the radius of curvature of the plate center line of the rolled material. Such an apparatus and method may be suitable for rolled material having a defined thickness, but is not suitable for thin, flexible web material, such as photosensitive web material.

U.S. Pat. No. 4,385,716 relates to a web controlling apparatus wherein the web may show a curvature about an axis normal to a plane. No teaching is made regarding measuring the amount of camber in the web.

Accordingly, a need exists for an apparatus and method to measure or quantify the amount of camber of a web material. Preferably such a determination would be made on-line, that is, as the web material is conveyed through a web handling system. Further, the apparatus and method should be suitable for thin, flexible web material, such as photosensitive web material.

SUMMARY OF THE INVENTION

An object of the invention is to provide an apparatus and method to measure or quantify the amount of camber of a web material.

Another object of the invention is to provide such an apparatus and method for measuring on-line the camber of a web material.

Still another object of the invention is to provide such an apparatus and method which is suitable for thin, flexible web material, such as photosensitive web material.

These objects are given only by way of illustrative example. Thus, other desirable objectives and advantages inherently achieved by the disclosed invention may occur or become apparent to those skilled in the art. The invention is defined by the appended claims.

According to one aspect of the invention, there is provided an apparatus for measuring camber in a web material. The apparatus includes a rotatable roller which conveys the web material, the roller having a first and second end. As the web is conveyed by the roller, a first and second edge detector detects a position of a first and second edge of the web material relative to a reference position. A first tension measuring apparatus, disposed at the first end of the roller, determines a tension applied to the roller at the first end, and provides a first electrical signal which corresponds to the applied tension. Similarly, a second tension measuring apparatus, disposed at the second end of the roller, determines the tension applied to the roller at the second end of the web material, and provides a second electrical signal which corresponds to the applied tension. A computer collects the first and second electrical signals and manipulates the first and second electrical signals to provide the camber measurement.

According to another aspect of the invention, there is provided a method for measuring camber in a web material. The web material is conveyed across a rotatable roller, the roller having a first and second end. The position of a first and second edge of the web material is determined relative to a reference position. As the web material is conveyed across the roller, a tension applied to the roller at the first and second end is determined. A first and second electrical signal is provided which corresponds to the applied tension determined at the first and second ends. The first and second electrical signals are transmitted to a computer where they are manipulated to provide the camber measurement.

The present invention allows camber to be measured on-line, and is suitable for thin, flexible web material, particularly photosensitive web material.

BRIEF DESCRIPTION OF THE DRAWINGS

The foregoing and other objects, features, and advantages of the invention will be apparent from the following more particular description of the preferred embodiments of the invention, as illustrated in the accompanying drawings.

FIG. 14 shows a table of values for an example in accordance with the present invention;

DETAILED DESCRIPTION OF THE INVENTION

Figures 2A, 2B, 2C, 2D:
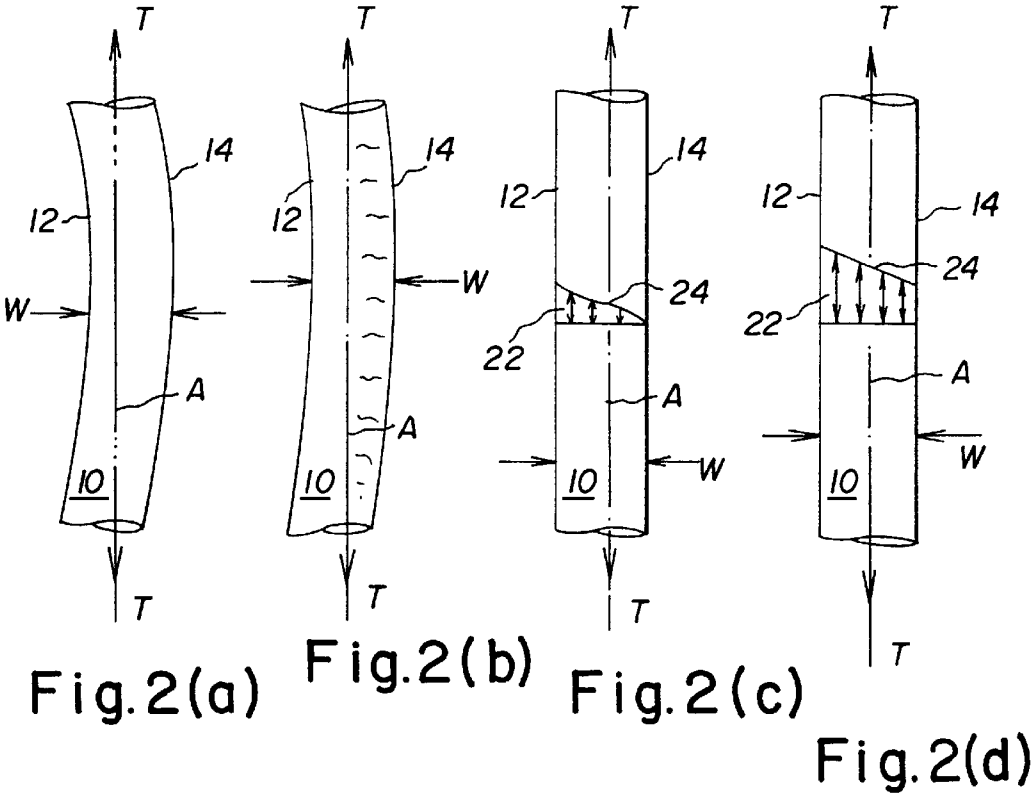
FIGS. 2(*a*) through 2(*d*) show a portion of web material having varying degrees of camber.

The following is a detailed description of the preferred embodiments of the invention, reference being made to the drawings in which the same reference numerals identify the same elements of structure in each of the several figures.

Figure 1:
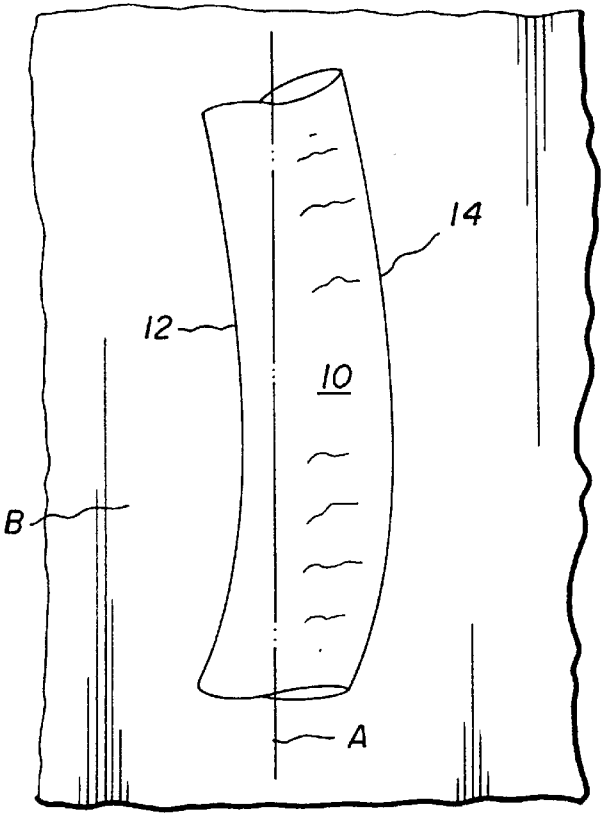
FIG. 1 shows a portion of web material having camber.

Camber can be detected in a length of web material 10 by several methods. Camber can be a result of one side of the web material being longer than the other side. As such, camber can often be visually observed. For example, as illustrated in FIG. 1, a first side 12 of web material 10, appears shorter, tight, or under tension, while a second side 14 of web material 10 appears loose or longer.

In a web having no camber, as a tension T is applied along axis A of the web, the lateral tension profile remains uniform across the web width. In contrast, FIGS. 2(*a*) through 2(*d*) illustrate the profile of web material 10 having camber as a tension T is applied along axis A of the web. As illustrated in FIG. 2(*a*), web material 10 having camber has some lateral curvature. As tension T is applied, first side 12 strains and appears tight while second side 14 appears loose (FIG. 2(*b*)). Referring to FIG. 2(*c*), as tension T increases in magnitude, the loose characteristics of second side 14 disappear, as does the visual observation of camber. As tension T is further increased, as illustrated in FIG. 2(*d*), web material 10 strains along its length. Note that as tension is applied to web material 10 having camber, a lateral tension profile 22 illustrated across width w of web material 10 remains substantially the same. This is shown in FIGS. 2(*c*) and (*d*) as lateral tension profile 22 having a slope 24 which is substantially equivalent.

Accordingly, when tension is applied to a cambered web being conveyed across a conveyance roller, the cambered web will produce an uneven tension distribution on the conveyance roller. This uneven or differential tension distribution can be measured and corresponded to camber. Therefore, the present invention measures slope 24 to quantify camber, with slope 24 being measured by determining a differential tension distribution produced as web material 10 is conveyed through a web handling system.

Figure 3A:
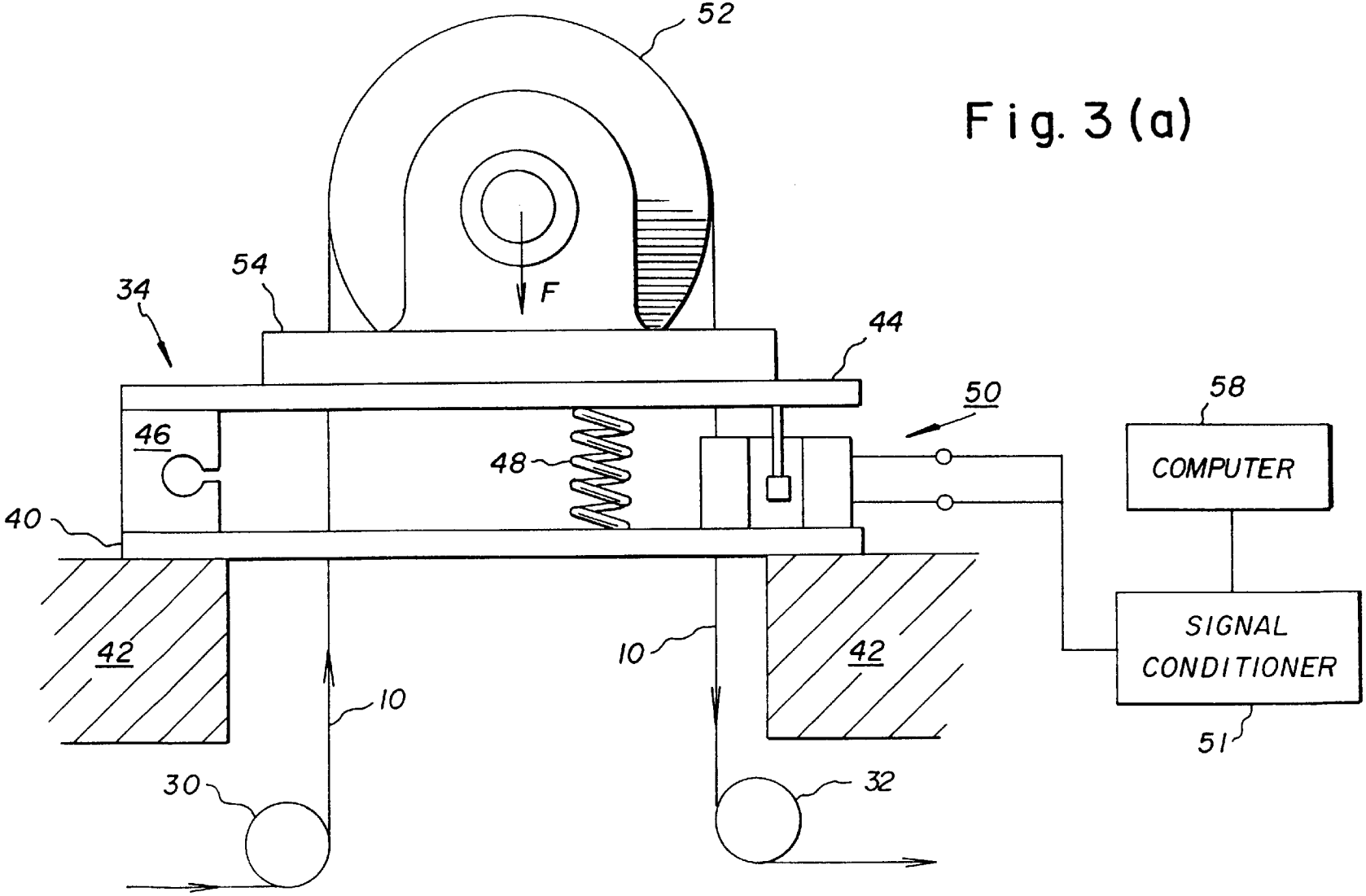
FIGS. 3(*a*) and 3(*b*) show a side view and a top view, respectively, of an apparatus for determining camber according to the present invention.
Figure 3B:
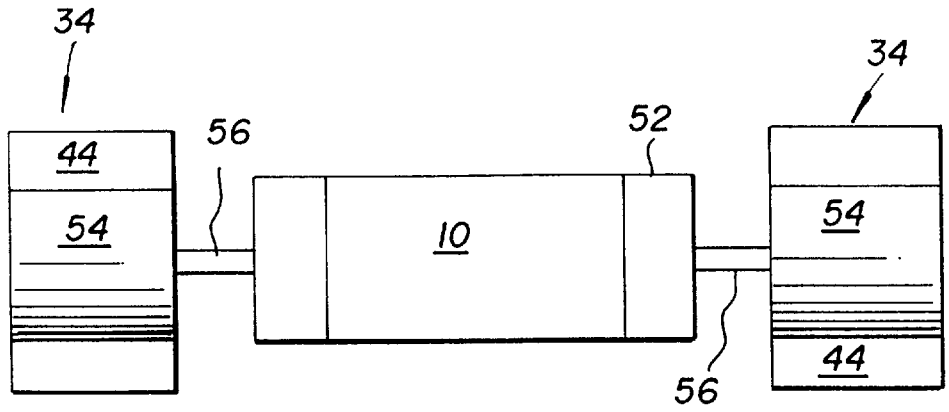

FIGS. 3(*a*) and 3(*b*) show an apparatus for measuring the camber of web material 10. Generally, web material 10 is transported between two transport rollers 30,32. Disposed between rollers 30,32 (i.e., upstream of roller 30 and downstream of roller 32) is a tension measuring apparatus 34. Suitable tension measuring apparatus are strain gages or a tension cell or load cell 34, which are commercially available. Hereinafter, tension measuring apparatus 34 will be referred to as load cell 34.

Load cell 34 is used to measure web tension and provide a correspondence between a force and an electrical signal. A typical load cell 34, as illustrated in FIG. 3(*a*), includes a base plate 40 mounted to a fixed frame 42, a load frame 44, a flexure 46, a spring 48, and a converter apparatus 50 and signal conditioner 51 for converting mechanical position to an electrical signal. Flexure 46 and spring 48 are disposed between base plate 40 and load table 44. Mounted to load cell 34 is a rotatable conveyance roller 52 which conveys web material 10. As illustrated, conveyance roller 52 is mounted on a bearing support 54 and rotates about a shaft 56. Web material 10 is conveyed about a portion of conveyance roller 52.

As web material 10 is transported between rollers 30,32, tension is applied to the web, causing a force F to be applied to conveyance roller 52. Force F is transmitted accordingly to load frame 44 causing spring 48 to compress. Flexure 46 flexes from the application of force F and load frame 44 pivots or rotates about flexure 46. The amount of mechanical movement of load frame 44 is measured and a corresponding electrical signal is provided by converter apparatus 50 and signal conditioner 51. The electrical signal is sent to a computer 58 which manipulates the signal to determine camber according to the relationship described below.

The present invention is particularly suited for photosensitive web material since it can be accomplished in a non-white light environment. Further, besides the contact with the conveyance roller for conveyance, no additional contact with the web material is required. Still further, the apparatus of the present invention can be retro-fitted to existing manufacturing equipment.

The following discussion provides a relationship between differential tension (across the width of the web) and camber. By providing such a relationship, camber can be measured or quantified.

Relationship between Arclength and Camber

Figure 4:
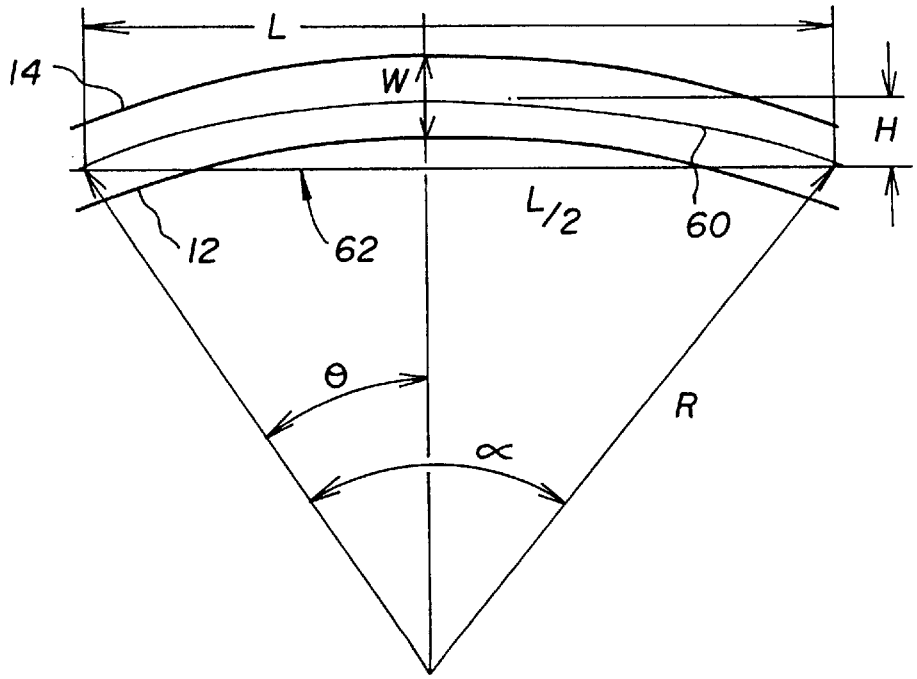
FIG. 4 shows a schematic view illustrative of the principle of the present invention.

The following discussion provides a relationship between arclength and camber. To determine camber, the configuration of load cell 34 is utilized. Referring to FIG. 4:

R is the radius of curvature of web material 10 (inches);

W is the lateral width of web material 10 (inches);

L is the length of web material 10 being measured (inches);

H is camber; a distance from a cord 62 to a centerline 60 of web material 10 (inches); cord 62 being disposed along the length L of web material 10 to the centerline;

$\alpha$ is an angle subtended by web material 10 (radians);

$\theta$ is an angle equal to one-half angle ox (radians),$\theta=\alpha/2$;

t is the thickness of web material 10 (inches); and

A is the cross-sectional area of web material 10; equal to W*t (inches$^2$).

An arclength of a web, as measured along centerline 60 of web material 10, subtended by $\alpha$ is:

$$\text{Arclength}=\alpha R \qquad \text{Equation 1}$$

The arclength of first side 12 of web material 10 (i.e., on the inside of the curvature) is:

$$Arclength_{inside} = \alpha\left(R - \frac{1}{2}W\right) \qquad \text{Equation 2}$$

The arclength of second side 14 of web material 10 (i.e., the web edge on the outside of the curvature) is:

$$Arclength_{outside} = \alpha\left(R + \frac{1}{2}W\right) \quad \text{Equation 3}$$

The differences (or delta) between these arclengths is defined as delta arclength ΔArclength:

$$\Delta Arclength = \alpha\left(R + \frac{1}{2}W\right) - \alpha\left(R - \frac{1}{2}W\right) = \alpha W \quad \text{Equation 4}$$

To develop the relationship between camber H and delta arclength ΔArclength, the sine of angle θ yields:

$$\theta = \arcsin\left(\frac{L/2}{R}\right) \quad \text{Equation 5}$$

Substituting α=2θ in to Equation 5:

$$\alpha = 2\ \arcsin\left(\frac{L/2}{R}\right) \quad \text{Equation 6}$$

The radius of curvature R of web material 10 can be expressed in terms of H and L:

$$R = \frac{L^2}{8H} + \frac{H}{2} \quad \text{Equation 7}$$

Substituting Equations 6 and 7 into Equation 4, delta arclength ΔArclength can be expressed as:

$$\Delta Arclength = 2\ \arcsin\left(\frac{4HL}{4H^2 + L^2}\right)W \quad \text{Equation 8}$$

Figure 5:
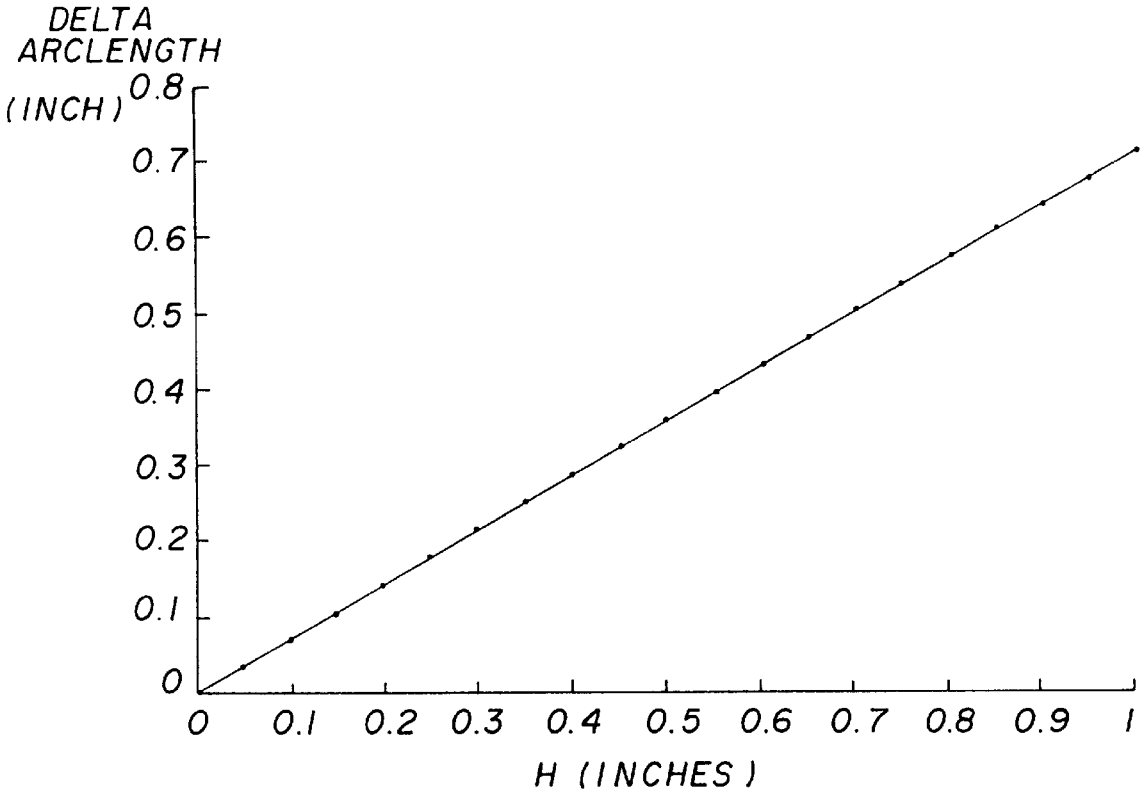
FIG. 5 shows a relationship between camber and delta arclength.

Equation 8 provides a relationship between delta arclength ΔArclength and camber H. illustrated in FIG. 5, when H is small compared to L, the relationship between ΔArclength and H is substantially linear.

For ease of illustration, the following equations are provided in terms of ΔArclength while the figures are displayed in terms of camber H.

Calculation of Web Stress

Standard equations for stress and strain dictate that a change in length ΔL of a material is equal to a force F applied times the length L of the material divided by the product of Young's Modulus E and the cross-sectional area A. That is:

$$\Delta L = F*L/(E*A) \quad \text{Equation 9}$$

wherein:

ΔL is a change in the length of web material 10 (inches);

L is the length of web material 10 being measured (inches);

E is Young's Modulus (pounds per square inch);

W is the lateral width of web material 10 (inches);

t is the thickness of web material 10 (inches);

A is the cross-sectional area of web material 10, equal to W*t (inches$^2$);

F is an applied force (inch-pounds); and

ΔAL is ΔArclength.

As previously discussed, and illustrated in FIGS. 2(*a*) through 2(*d*), if tension T is applied to web material 10 having camber, first side 12 will start to draw tight while second side 14 will appear loose and baggy. As the tension is increased the amount of cross directional web that appears tight will increase. At some level of tension the entire web will appear tight. At this point, the visually apparent camber will be removed from the web. The force required to straighten the web, or remove the visually apparent camber, can be calculated by the following equations.

Figure 6:
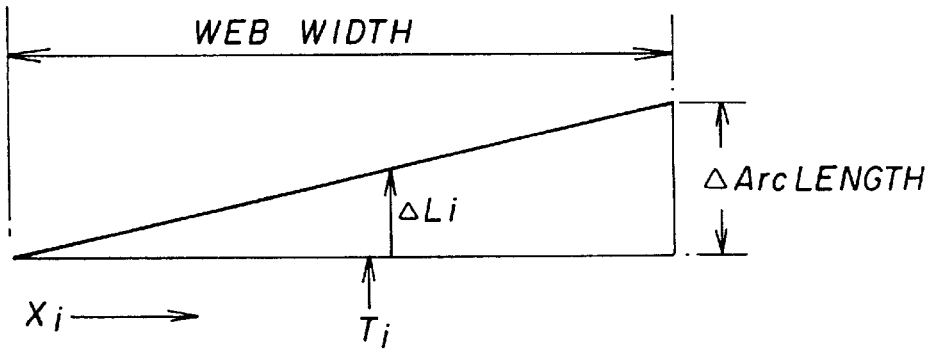
FIG. 6 shows a schematic view illustrative of the principle of the present invention.

Referring to FIG. 6, the change in length ΔL at a particular interval i is:

$$\Delta L_i = x_i/W*\Delta AL \quad \text{Equation 10}$$

Still referring to FIG. 6, the tension T at a particular interval i is:

$$T_i = \Delta L_i*t*E/L \quad \text{Equation 11}$$

$$T_i = \frac{\Delta AL*t*E}{W*L}*x_i \quad \text{Equation 12}$$

The tension required to straighten a cambered web, or remove apparent camber, is derived by integrating both sides of Equation 12 over the web width W:

$$\text{Tension Required} = \frac{\Delta AL*t*E}{W*L}\int_0^w x\,dx \quad \text{Equation 13}$$

For example, for an acetate web of approximately 0.005 inches thick, 54 inches wide and 50 feet (600 inches) in length, and having a Young's Modulus of $6\times10^6$ psi, then Equation 13 becomes:

$$\text{Tension Required} = 0.92592*\Delta Arclength\int_0^{54} x\,dx \quad \text{Equation 14}$$

Figure 7:
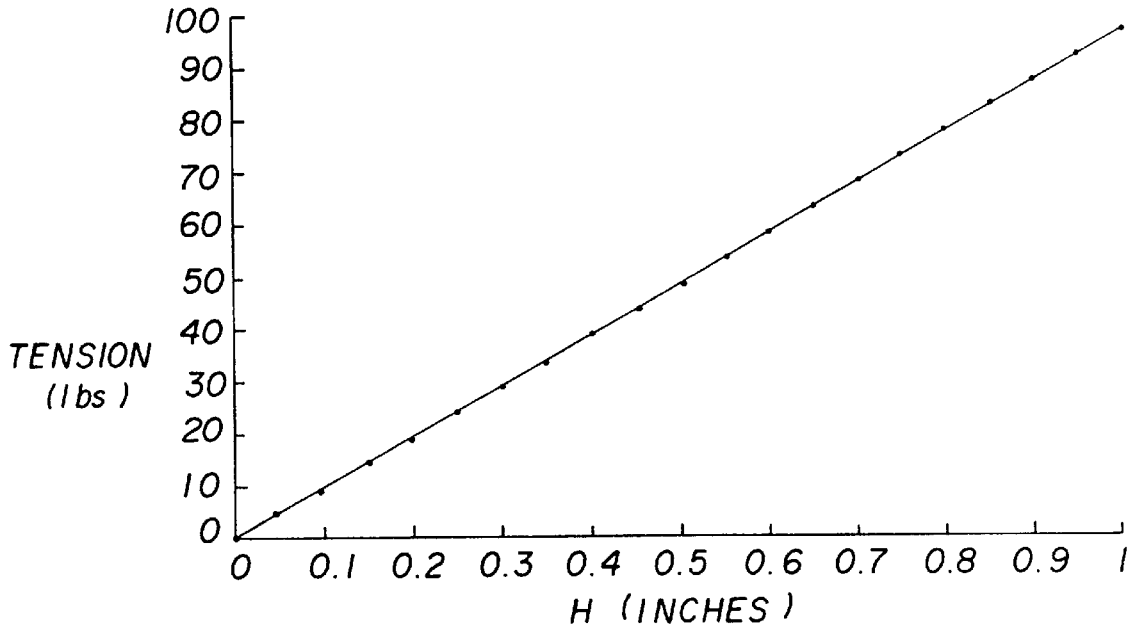
FIG. 7 shows a relationship between tension and camber for an example in accordance with the present invention.

A plot of Equation 14 is illustrated in FIG. 7. As illustrated in the figure, for small values of H with respect to L, the relationship between the tension required to remove visually apparent camber in the web and H is linear.

Web Edge Detection

Figure 8:
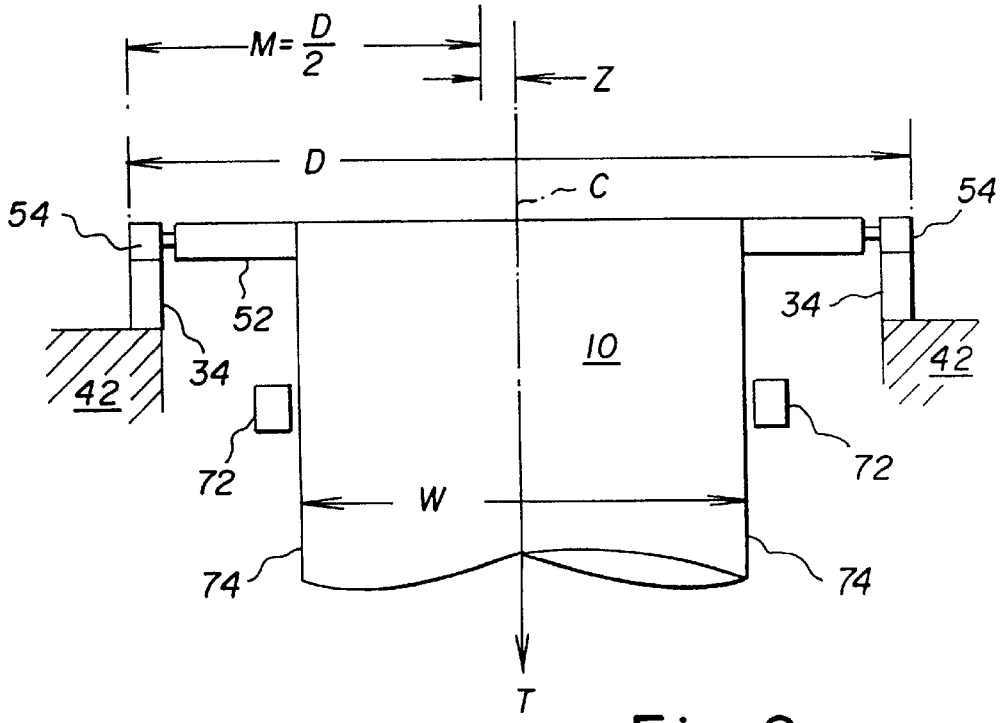
FIG. 8 shows a front view of an apparatus for measuring camber in accordance with the present invention.

FIG. 8 generally illustrates an on-line web camber measurement apparatus according to the present invention. Web 10 is transported across conveyance roller 52 mounted for rotation. Such conveyance roller 52 is typically longer in length than the width W of web material 10. A load cell 34 is disposed at each end of roller 52. The distance between the load cells is referred to as Distance D. The midpoint M between the load cells is equal to D/2.

The width W of web material 10 and the position of web material 10 relative to a reference position can be determined using well known devices. Edge Detectors 72, for example, air fingers, ultrasonic, and visible or infra red (IR) light sensors, can be used to detect a location of an edge 74 of web material 10. A suitable edge detector 72 for the present invention is an IR Edge Sensor Model 950 from Erhard & Leimer. Such a sensor provides a ± voltage output for web location within a range of about ±0.472 inches.

Referring again to FIG. 8, edge detectors 72 are disposed along the path of transport of web material 10. Preferably, one edge detector 72 is positioned on each side 12,14 of web material 10. For convenience of operation, if the nominal web width W is known, edge detectors 72 can be calibrated to produce a 0 volt output when web material 10 is centered between load cells 34; hereinafter referred to as the center position. The edge detector 72 can then be calibrated to provide a particular voltage to correspond with particular deviation of the edges of web material 10. For example, edge detector 72 may indicate ±4 volts for each ±- 0.4 inch deviation from the center position. The actual width W would then be the nominal width plus the sum of the sensor voltages divided by 10. An offset Z, defined as the distance from the center axis C of web material 10 to Midpoint M, would then be the difference between the two sensor voltages divided by 20.

Force Calculation; Load Cells Positioned at each Side of Web

A load cell 34 is disposed on each side 12,14 of web material 10, along edge 74 of each side. As web material 10 is transported across roller 52, tension is applied to the web. As a result of camber or differential tension in the web, an independent force can be measured at each load cell 34; F1 and F2 as illustrated in FIG. 8.

Figure 9:
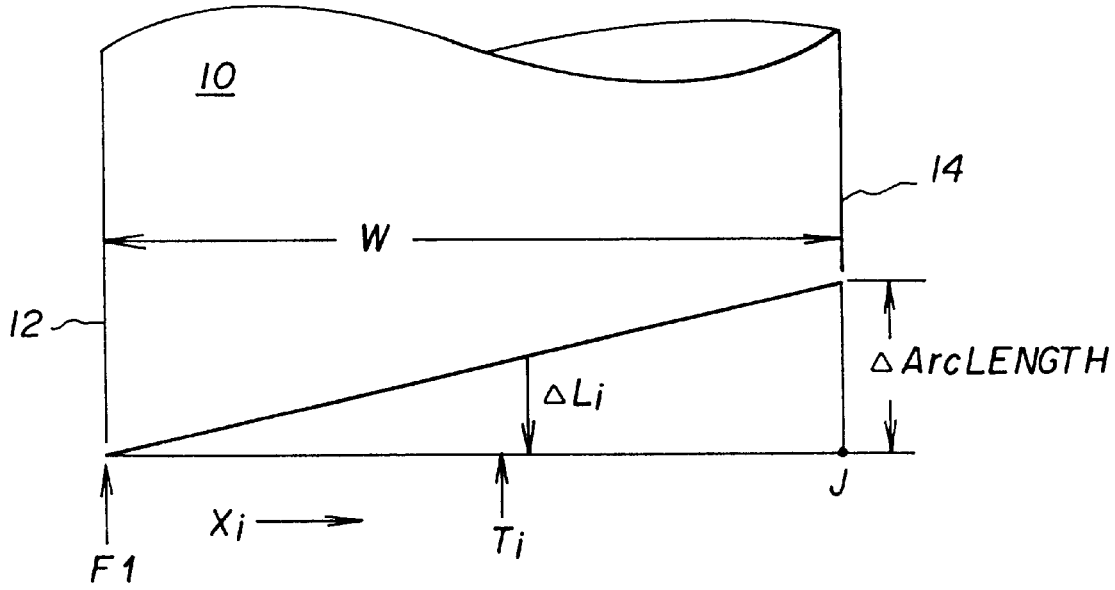
FIG. 9 shows a schematic view illustrative of the principle of the present invention with regard to a first force.

Referring now to FIG. 9, $F_1$ can be determined by summing the tension $T_i$ about point J:

$$F_1=\Sigma T_i \text{ about point J} \qquad \text{Equation 15}$$

The resulting force $F_1$ as a result of tension T at point i is:

$$F_{1i}=(W-x_i)/W*T_i \qquad \text{Equation 16}$$

As seen earlier in Equation 12:

$$T_i = \frac{\Delta AL*t*E}{W*L}*x_i \qquad \text{Equation 17}$$

Substituting Equation 17 into Equation 16, the force at $F_1$ as a result of the tension T at point i ($T_i$) is expressed as:

$$F_{1i} = \frac{W-x_i}{W}*\frac{\Delta AL*t*E}{W*L}*x_i \qquad \text{Equation 18}$$

The tension T is integrated over the width W of the web to obtain $F_1$:

$$F_1 = \frac{\Delta AL*t*E}{W^2*L}\int_0^w (W*x-x^2)dx \qquad \text{Equation 19}$$

Figure 10:
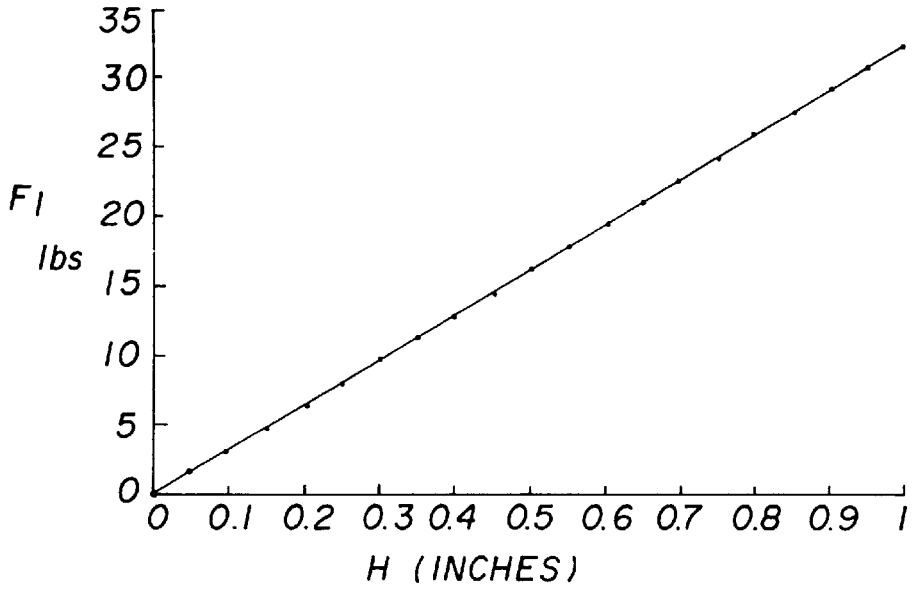
FIG. 10 shows a relationship between a first force and camber for an example in accordance with the present invention.

For example, FIG. 10 shows a plot of camber H versus force $F_1$ for a web material 10 having a thickness of 0.005 inches, a Young's Modulus E of $6\times10^6$ psi, a width W of 54 inches, and a length L of 600 inches. (Equations 8 and 19.) As can be seen from the figure, for small values of camber H, the force $F_1$ is linear with regard to camber H.

Figure 11:
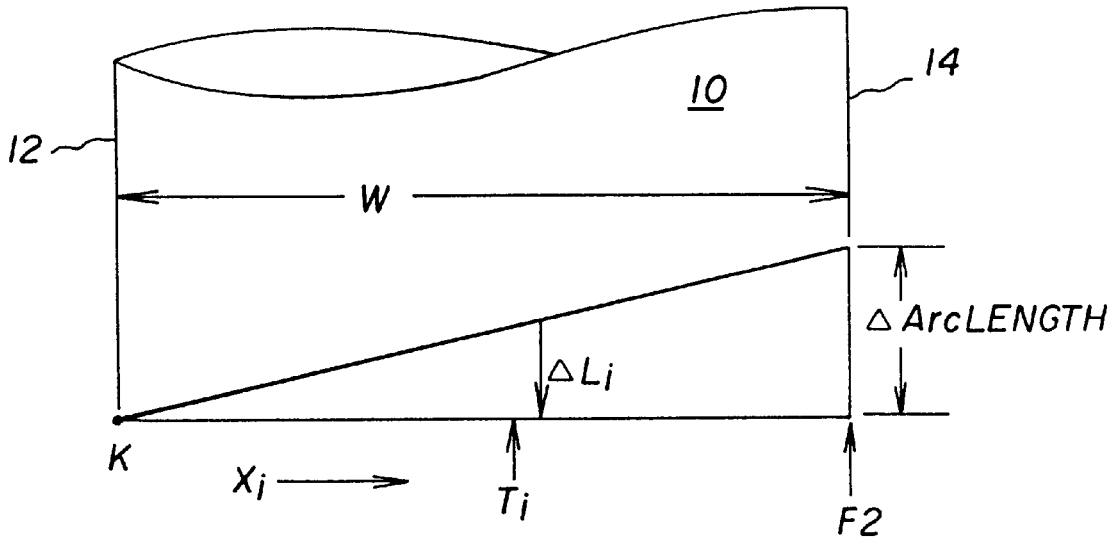
FIG. 11 shows a schematic view illustrative of the principle of the present invention with regard to a second force.

Referring now to FIG. 11, Similarly, $F_2$ is determined by summing the tension $T_i$ about point K:

$$F_2=\Sigma T_i \text{ about point K} \qquad \text{Equation 20}$$

The resulting force $F_2$ as a result of tension T at point i is:

$$F_{2i}=x_i/W*T_i \qquad \text{Equation 21}$$

As seen earlier in Equation 12:

$$T_i = \frac{\Delta AL*t*E}{W*L}*x_i \qquad \text{Equation 22}$$

Substituting Equation 22 into Equation 21, the force at $F_2$ as a result of the tension T at point i ($T_i$) is expressed as:

$$F_{2i} = \frac{x_i}{W}*\frac{\Delta AL*t*E}{W*L}*x_i \qquad \text{Equation 23}$$

The tension T is integrated over the width W of the web to obtain $F_2$:

$$F_2 = \frac{\Delta AL*t*E}{W^2*L}\int_0^w x^2dx \qquad \text{Equation 24}$$

Figure 12:
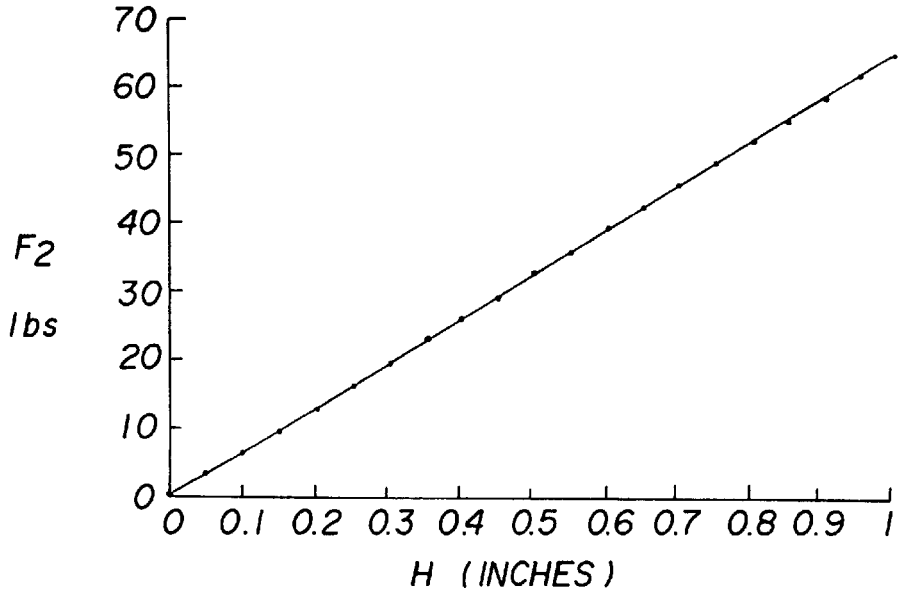
FIG. 12 shows a relationship between a second force and camber for an example in accordance with the present invention.

For the same example as above (i.e., a web material 10 having a thickness of 0.005 inches, a Young's Modulus E of $6\times10^6$ psi, a width W of 54 inches, and a length L of 600 inches), FIG. 12 shows a plot of camber H versus force $F_2$. (Equations 8 and 24.) As can be seen from the figure, for small values of camber H, the force $F_2$ is linear with regard to camber H.

Figure 13:
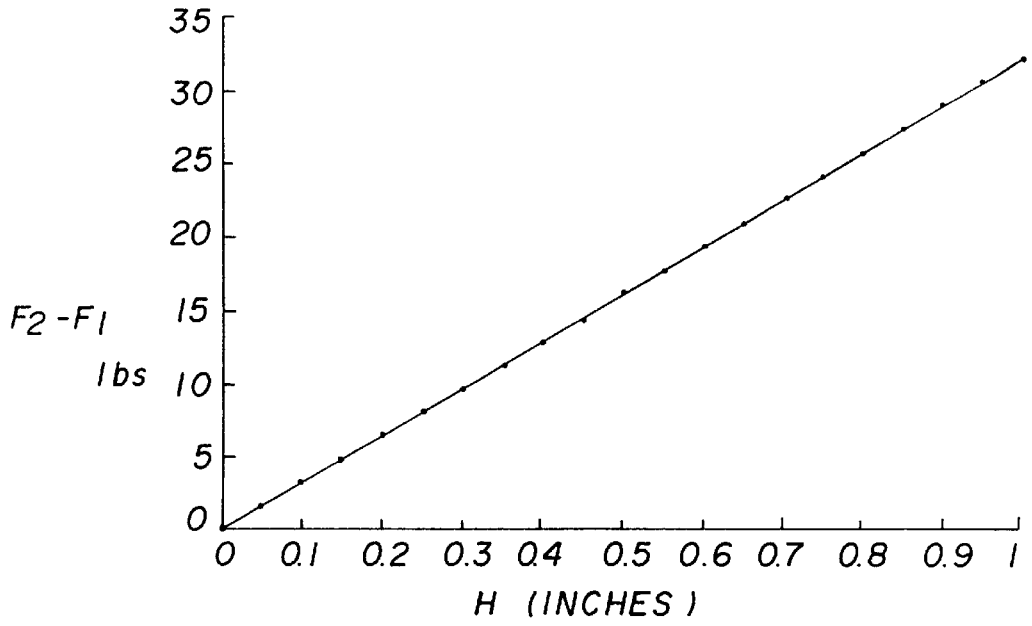
FIG. 13 shows a relationship between a Differential Tension and camber for an example in accordance with the present invention.

FIG. 13 shows a Differential Tension resulting from the above example (i.e., FIGS. 10 and 12) as a function of camber H; Differential Tension being defined as the difference between $F_1$ and $F_2$. As illustrated in the figure, there is a linear relationship between Differential Tension and camber H. FIG. 14 provides the numerical values plotted in FIGS. 10, 12, and 13.

From a plot such as FIG. 13, the slope of the line C can be determined:

$$C = \frac{\Delta(F_2-F_1)}{\Delta H} \qquad \text{Equation 25}$$

wherein C is the slope of the line for a particular set of web parameters.

For example, using the values from FIGS. 13 and 14 (i.e., a web material 10 having the parameters of a thickness of 0.005 inches, a Young's Modulus E of $6\times10^6$ psi, a width W of 54 inches, and a length L of 600 inches), the value of C is approximately 32.4.

The general equation for the line illustrated in FIG. 13 (the y-intercept of the slope being 0), is $F_2-F_1=C*H$. Solving for H yields:

$$H=(F_2-F_1)/C \qquad \text{Equation 26}$$

Therefore, for the particular example noted above:

$$H = \frac{F_2-F_1}{32.4}$$

Force Calculation; Load Cells not Positioned at each Side of Web

Typically, roller 52 is longer in length than width W of web material 10. As shown in FIG. 8, the distance D between load cells 34 is greater than width W of web material 10. Therefore, load cell 34 may not be able to be physically mounted at the edge of web material 10, and a direct measure of $F_1$ and $F_2$ cannot be made. As such, Differential Tension $F_2-F_1$ may be different than a differential tension measured by load cells not positioned at the edge of web material 10. Further, width W may vary for a particular length L of web material 10. In addition, as web material 10 is transported across roller 52, web material 10 may track off center and weave.

To address the off center tracking and weave, edge detectors 72, previously described, accordingly provide a measure of width W and offset Z as web material 10 is transported.

To compensate for load cells 34 not being mounted at the edge of web material 10, the values of $F_1$ and $F_2$ are calculated as follows.

(a) Web Centered between Load Cells

Figure 15:
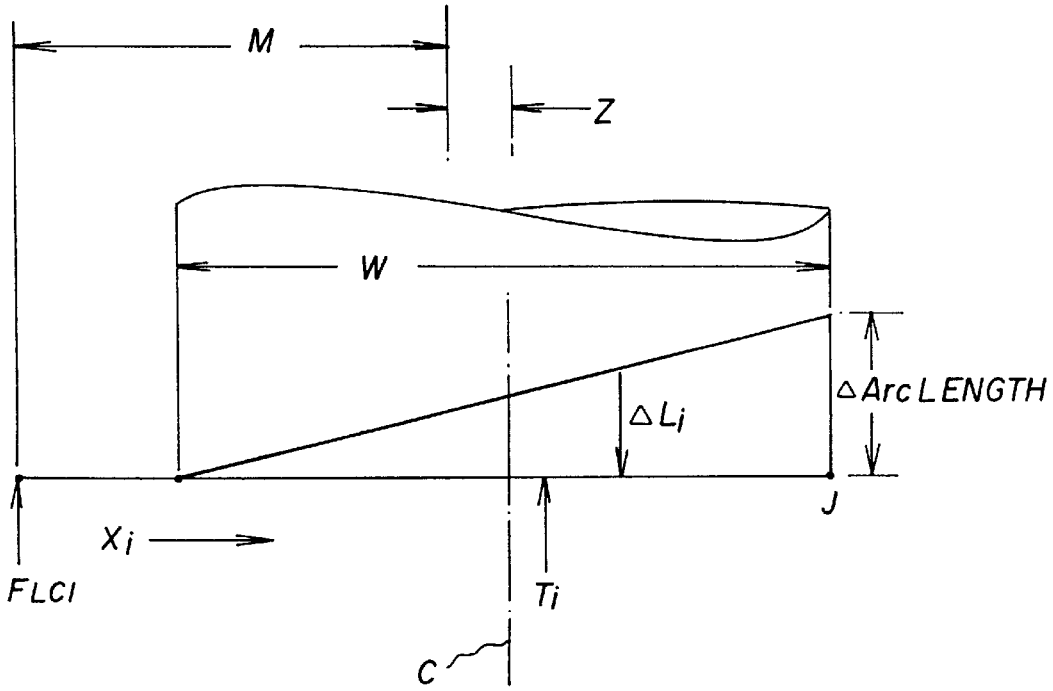
FIG. 15 shows a schematic view illustrative of the principle of the present invention with regard to a first force applied at an end of a conveyance roller.

Referring to FIG. 15, and assuming that web material 10 is centered between the load cells (i.e., that offset Z=0), a force $F_{LC1}$ measured at a first load cell not mounted at the edge of web material 10 is:

$$F_{LC1} * D = \frac{1}{2}(D - W) * F_2 + \left(\frac{1}{2}(D - W) + W\right) * F_1 \quad \text{Equation 27}$$

wherein:

D is the distance between the centerline of the load cells (inches); and

W is the lateral width of web material 10 (inches).

Rearranging:

$$F_{LC1} = \frac{F_1 * (D + W) + F_2 * (D - W)}{2 * D} \quad \text{Equation 28}$$

Figure 16:
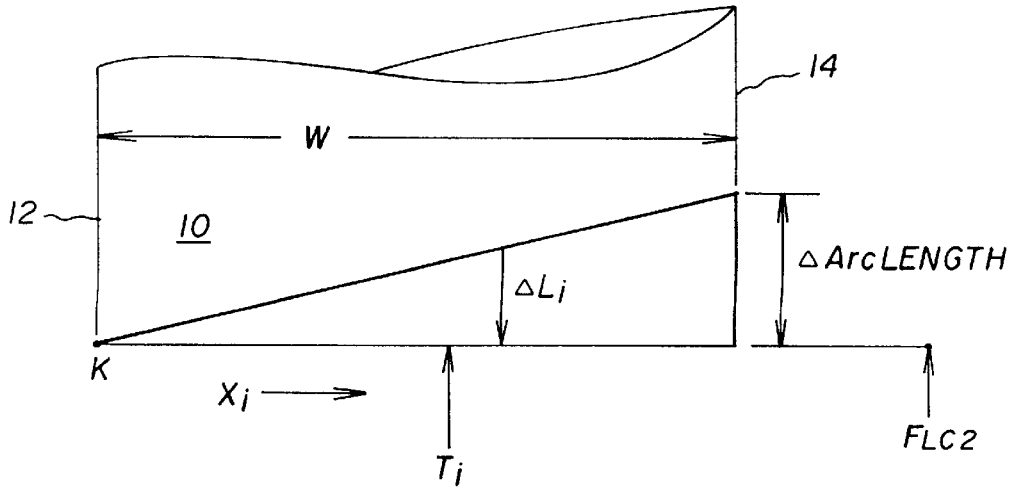
FIG. 16 shows a schematic view illustrative of the principle of the present invention with regard to a second force applied at an end of a conveyance roller.

Similarly, referring to FIG. 16, and assuming that web material 10 is centered between the load cells (i.e., that offset Z=0), a force $F_{LC2}$ measured at a second load cell not mounted at the edge of web material 10 is:

$$F_{LC2} * D = \frac{1}{2}(D - W) * F_1 + \left(\frac{1}{2}(D - W) + W\right) * F_2 \quad \text{Equation 29}$$

Rearranging:

$$F_{LC2} = \frac{F_1 * (D - W) + F_2 * (D + W)}{2 * D} \quad \text{Equation 30}$$

Subtracting $F_{LC1}$ from $F_{LC2}$ and reducing:

$$F_{LC2} - F_{LC1} = D(F_2 - F_1) \quad \text{Equation 31}$$

Solve for $F_2 - F_1$:

$$F_2 - F_1 = \frac{D}{W}(F_{LC2} - F_{LC1}) \quad \text{Equation 32}$$

Accordingly, the differential web tension $F_2 - F_1$, for the situation wherein the load cell 34 is not mounted at the edge of web material 10, is the ratio of the distance between the load cells and the web width times the measured differential tension.

(b) Web not Centered between Load Cells

When web material 10 is not centered on roller 70, then there is an offset Z from center C, and the following equation applies for $F_{LC1}$:

$$F_{LC1} * D = \left[\frac{1}{2}(D - W) + Z\right] * F_2 + \left(\frac{1}{2}(D - W) + W + Z\right) * F_1 \quad \text{Equation 33}$$

wherein:

D is the distance between the centerline of the load cells (inches);

W is the lateral width of web material 10 (inches); and

Z is the distance that the web centerline C is offset from the center of the load cells (inches).

Rearranging:

$$F_{LC1} = \frac{F_1 * (D + W + 2 * Z) + F_2 * (D - W + 2 * Z)}{2 * D} \quad \text{Equation 34}$$

Similarly, for $F_{LC2}$:

$$F_{LC2} * D = \left[\frac{1}{2}(D - W) - Z\right] * F_1 + \left(\frac{1}{2}(D - W) + W - Z\right) * F_2 \quad \text{Equation 35}$$

Rearranging:

$$F_{LC2} = \frac{F_1 * (D - W - 2 * Z) + F_2 * (D + W - 2 * Z)}{2 * D} \quad \text{Equation 36}$$

Subtracting $F_{LC1}$ from $F_{LC2}$ and reducing:

$$F_{LC2} - F_{LC1} = \frac{W(F_2 - F_1) - 2 * Z(F_2 + F_1)}{D} \quad \text{Equation 37}$$

The total tension in web material 10 is $F_1 + F_2$, while the total tension measured is $F_{LC1} + F_{LC2}$. Accordingly:

$$F_{LC1} + F_{LC2} = F_1 + F_2 \quad \text{Equation 38}$$

Substituting $F_{LC1} + F_{LC2}$ from Equations 38 into Equation 37 and solving for $F_2 - F_1$ yields:

$$F_2 - F_1 = \frac{D}{W}(F_{LC2} - F_{LC1}) + \frac{2 * Z * (F_{LC2} + F_{LC1})}{W} \quad \text{Equation 39}$$

Determination of Camber

By measuring the forces on the load cells, web width, and offset, the differential web tension can be determined by Equation 39. The differential tension can then be substituted into Equation 26 to determine camber H. As such, camber can be measured or quantified.

In operation, the apparatus is set up, and the parameters (for example, C, D, M, Z) are obtained. For a particular width W, voltage signals from the load cells are obtained, and converted into the values of $F_{LC1}$ and $F_{LC2}$ (from a calibration setup). The value of $F_2 - F_1$ is then determined from Equation 39 with camber H being calculated using Equation 26.

Figure 17:
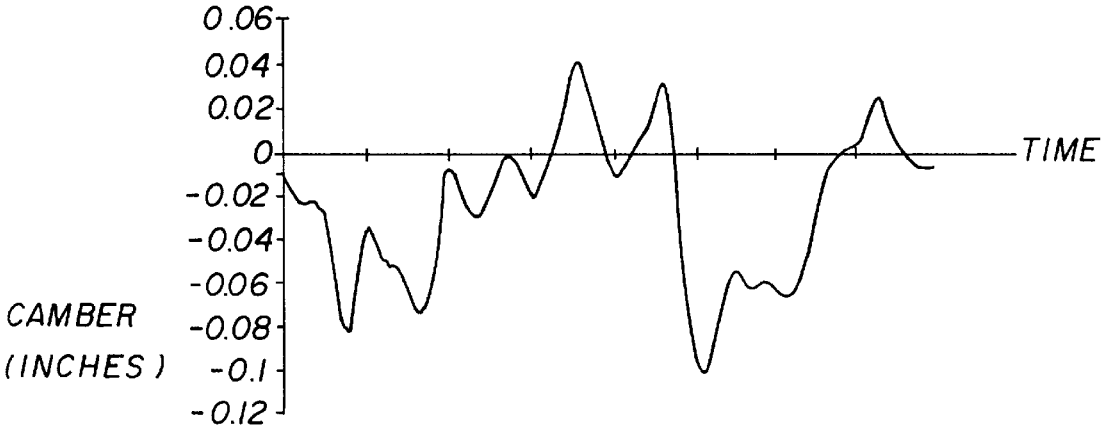
FIG. 17 shows a plot of camber versus time for a particular length of web.

For example, for a particular length of web material, a camber measurement is made at a particular width location of the web. If camber measurements are made at several width locations, a plot of camber versus time can illustrate how camber is changing through the length of the moving web. FIG. 17 illustrates a plot of camber H versus time for a particular length of moving web material. Note the negative/positive values of camber, indicating that camber is changing from one side to the other side of the web.

As shown in FIG. 8, the measurement of camber H can be obtained on-line, during the manufacturing process without disruption to the manufacturing process.

A measurement of camber H can be applied to the manufacturing process. For example, since camber can be an indication of how the web will track when conveyed, a web found to have a high camber may be rejected from further processing.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. An apparatus for measuring camber in a web material, the web material having a first and second edge, comprising:

a rotatable roller conveying the web material, said roller having a first and second end;

a first and second edge detector detecting a position of said first and second edges, respectively, relative to a reference position as the web is conveyed by said roller;

a first tension measuring apparatus disposed at said first end of said roller, said first tension measuring apparatus determining the tension applied to said roller at said first end as the web material is conveyed across said roller, a first electrical signal being provided which corresponds to the applied tension;

a second tension measuring apparatus disposed at said second end of said roller, said second tension measuring apparatus determining the tension applied to said roller at said second end as the web material is conveyed across said roller, a second electrical signal being provided which corresponds to the applied tension; and a computer for collecting said first and second electrical signals and manipulating said first and second electrical signals to provide the camber measurement according to the equation Camber=Differential Tension/C wherein:

$$\text{Differential Tension} = \frac{D}{W}(F_{LC2} - F_{LC1}) + \frac{2*Z*(F_{LC2} + F_{LC1})}{W};$$

C is a constant for a particular set of web material parameters,

D is a distance between said first and second load cells, $F_{LC1}$, $F_{LC2}$ are a first and second load cell force corresponding to said first and second electrical signals, respectively, W is a lateral width of the web material, and Z is a distance that the web material is offset from a midpoint between said first and second load cells.

2. The apparatus according to claim 1 wherein said first and second tension measuring apparatus are load cells.

3. A method for measuring camber in a web material, the web material having a first and second edge, comprising:

conveying a web material across a rotatable roller, said roller having a first and second end;

disposing a first and second load cell at said first and second ends of said roller, respectively;

determining the position of the first and second edges relative to a reference position;

measuring a mechanical movement of said first load cell as the web material is conveyed across said conveyance roller;

converting said mechanical movement of said first load cell to a first electrical signal corresponding a tension applied to said roller at said first end;

measuring a mechanical movement of said second load cell as the web material is conveyed across said conveyance roller;

converting said mechanical movement of said second load cell to a second electrical signal corresponding to a tension applied to said roller at said second end;

transmitting said first and second electrical signals to a computer; and converting said first and second electrical signals into a corresponding first and second load cell force $F_{LC1}$, $F_{LC2}$, respectively;

determining a differential tension according to the equation:

$$\text{Differential Tension} = \frac{D}{W}(F_{LC2} - F_{LC1}) + \frac{2*Z*(F_{LC2} + F_{LC1})}{W}; \text{ and}$$

determining the camber measurement according to the equation:

Camber=Differential Tension/C wherein:

C is a constant for a particular set of web material parameters,

D is a distance between said first and second load cells,

W is a lateral width of the web material, and

Z is a distance that the web material is offset from a midpoint between said first and second load cells.

* * * * *